US006217299B1

(12) United States Patent
Jay

(10) Patent No.: US 6,217,299 B1
(45) Date of Patent: Apr. 17, 2001

(54) INTEGRATED PUMP AND TAPPET UNIT FOR A FUEL FEEDING SYSTEM

(75) Inventor: David C. Jay, Vähäkyrö (FI)

(73) Assignee: Wartsila NSD Oy AB, Helsinki (FI)

( * ) Notice: Subject to any disclaimer, the term of this patent is extended or adjusted under 35 U.S.C. 154(b) by 0 days.

(21) Appl. No.: 09/347,340

(22) Filed: Jul. 2, 1999

(30) Foreign Application Priority Data

Jul. 3, 1998 (FI) ..... 981537

(51) Int. Cl.[7] ..... F04B 19/00
(52) U.S. Cl. ..... 417/470; 123/495; 92/153
(58) Field of Search ..... 417/470; 123/495, 123/90.48; 92/153, 165 R, 168, 68, 129

(56) References Cited

U.S. PATENT DOCUMENTS

| | | | | |
|---|---|---|---|---|
| 3,902,404 | * | 9/1975 | Breit | 92/153 |
| 3,951,046 | * | 4/1976 | Lochmann et al. | 92/129 |
| 4,465,049 | * | 8/1984 | Eckert et al. | 123/446 |
| 5,419,298 | * | 5/1995 | Nolte et al. | 123/508 |
| 5,567,134 | | 10/1996 | Inoue . | |

FOREIGN PATENT DOCUMENTS

| | | | | |
|---|---|---|---|---|
| 608638 | * | 11/1960 | (CA) | 92/129 |
| 80328 | | 1/1990 | (FI) . | |
| 38637 | * | 6/1931 | (FR) | 123/495 |
| 2 129 883 | | 5/1984 | (GB) . | |

* cited by examiner

*Primary Examiner*—Charles G. Freay
*Assistant Examiner*—Cheryl J. Tyler
(74) *Attorney, Agent, or Firm*—John Smith-Hill; Smith-Hill and Bedell

(57) ABSTRACT

An integrated pump and tappet unit for an internal combustion engine, includes a pump and tappet unit body composed of a one-piece casting, a tappet fitted in the body to be driven by the engine, a tappet arm connected to the tappet, and a piston operationally connected to the tappet through the tappet arm and arranged to pump fuel from a fuel chamber in the pump and tappet body under high pressure to be fed to one or more cylinders of the engine. A flange is fixed to the pump and tappet body and the tappet arm extends through the flange, so that the piston and the tappet are at opposite respective sides of the flange, and the flange is in sealing relationship with the tappet arm so that passage of fuel from the piston side of the flange to the tappet side of the flange is inhibited.

8 Claims, 3 Drawing Sheets

INTEGRATED PUMP AND TAPPET UNIT FOR A FUEL FEEDING SYSTEM

BACKGROUND OF THE INVENTION

This invention relates to an integrated pump and tappet unit for a fuel feeding system of an internal combustion engine.

Large diesel engines refer here to such engines that are applicable for instance for main propulsion engines or auxiliary engines for ships or for power plants for production of heat and/or electricity.

In order to accomplish fuel injection under high pressure into a cylinder of an engine a high pressure pump is needed as well as phasing of the operation of the pump according to the operating cycle of the cylinder, which can be accomplished by means of a tappet member controlled by a cam shaft or the like member of the engine. In so-called common pressure or common rail systems and their applications this kind of phasing is not necessary, but nevertheless the operation of the pump may be controlled by means of corresponding members. In accordance with known techniques the pump and the tappet are arranged to be entirely separate units. In this case a separate lubrication is arranged for the pump, whereby fuel, especially heavy oil utilized in modern engines, cannot enter the tappet unit, in which it could be mixed with the lubrication oil. The pump and tappet then each need, however, a body of their own, which increases the manufacturing costs and requires more space.

It is further known to connect the pump and the tappet to each other, which makes the construction simpler and decreases the manufacturing costs. However, in known solutions in which the pump and tappet are connected together, mixing of the fuel with the lubrication oil is possible, as a consequence of which the quality of the lubrication oil decreases and affects the whole circulation of lubricant. This may result in the pump and the tappet becoming stuck and may even result in damage of various kinds to the bearings, including the crank shaft bearings.

SUMMARY OF THE INVENTION

An aim of the invention is to provide an improved pump and tappet unit, with which the advantages of integration can be achieved but from which the drawbacks of the known solutions can be eliminated. A further aim is to create a solution which is applicable to high pressure feeding of fuel and which may easily be connected as part of a fuel feeding system in which a pressure accumulator unit common to at least two cylinders of an engine is utilized and in which the fuel is first pumped under low pressure from a fuel tank into the system.

In accordance with the invention the pump and tappet body comprises a one-piece casting and the tappet member and the piston member are connected to each other by means of a tappet arm which passes sealingly through a flange member fixed to the body so that entry of fuel from the fuel chamber to the side of the tappet member is prevented. When the members required for both the pumping and tappet functions are arranged inside of such a one-piece pump and tappet body, a simple and cost effective solution can be accomplished.

A one-piece casting, as opposed to an assembly of multiple pieces, is essentially homogeneous. Use of a one-piece casting for the pump and tappet body is advantageous because the one-piece casting is simple and inexpensive to construct and manufacture, and avoids certain disadvantages associated with manufacturing the body from multiple pieces, such as the presence of joints through which fuel can leak and the cost of assembly.

The flange member is with advantage provided with a duct for leading lubrication oil into a lubricator groove abutting the tappet arm. By further providing the flange member with a sealing ring, which is located between the lubricator groove and the fuel chamber, mixing of fuel and lubrication oil, with harmful results for the operation of the unit, can effectively be prevented. The body may further include a chamber located between the flange member and the piston member for collecting possible fuel leaked from the fuel chamber. When the collecting chamber is provided with a drain duct the space above the flange member remains de-pressurized, which is advantageous for the sealing arrangement in the flange member and hereby assists in fulfilling the aims of the invention.

The fuel chamber is with advantage connected through a non-return valve to a low pressure fuel line included in the fuel feeding system for leading fuel from a fuel tank into the fuel chamber. In addition the low pressure fuel line is provided with a control valve upstream of the non-return valve. In this way, the arrangement according to the invention can with advantage form a part of a fuel feeding system, in which the feeding of fuel from a fuel tank into the cylinders of an engine occurs through both a low pressure part and a high pressure part of the feeding system.

The body with advantage includes a pipe element or structure, through which the low pressure fuel line is led, and has ducts for connecting the pipe element with the fuel chamber. In addition the pipe elements of the bodies of successive pump and tappet units are connected to each other for providing a common low pressure fuel line. By leading the fuel further through a constant pressure valve of the like back into the fuel tank, the uniform low pressure fuel feeding line can be arranged to form a closed loop.

BRIEF DESCRIPTION OF THE DRAWINGS

In the following the invention is described, by way of example, with reference to the attached drawings, in which.

DETAILED DESCRIPTION

Figure 1:
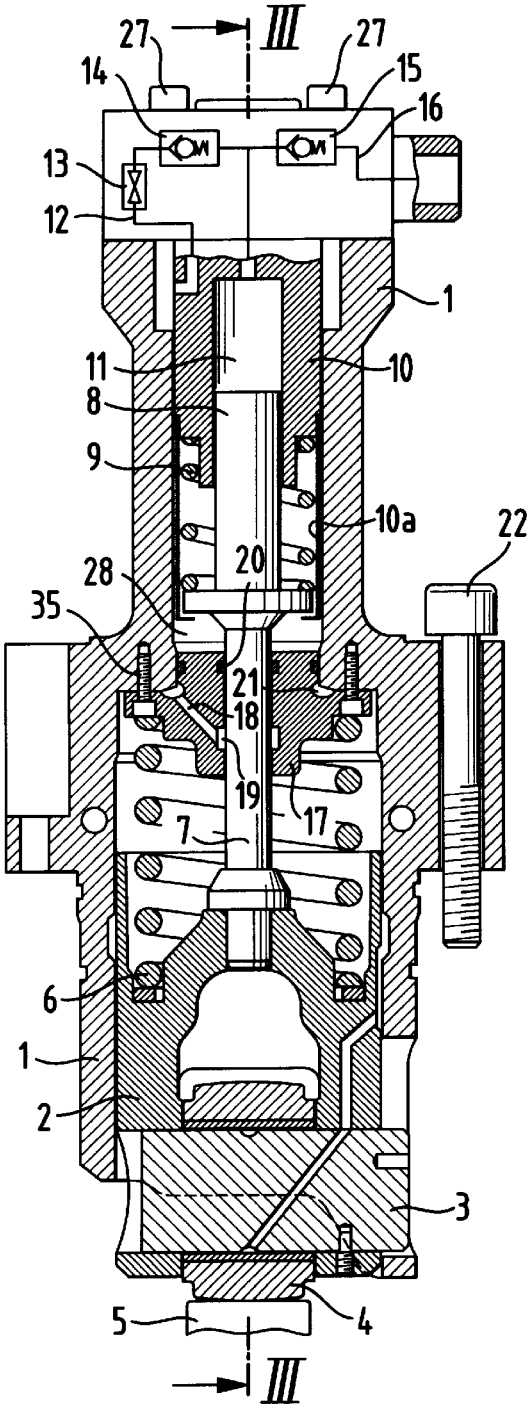
FIG. 1 shows an embodiment of a pump and tappet unit according to the invention in section and the tappet in its lower position.

In the drawing 1 indicates a pump and tappet body, which is mounted on an engine, for instance on its so-called console support (not shown more closely), by means of screw bolts 22. The pump and tappet body 1 encloses a tappet member 2 movable in the body 1 against the force of a spring 6 and to which a roll follower 4 is journalled by means of a stub shaft 3. Reciprocating movement of the tappet member 2 is controlled in known manner through the roll follower 4 cooperating with a cam race 5, which is included in a cam of a cam shaft of the engine (not shown).

Attached to the tappet member 2 there is a tappet arm 7, at one end of which a piston member 8 is connected to be movable against the force of a spring 9. A cover element 10, including a cylindrical part defining a fuel chamber 11, is fixed to the body 1 by means of screw bolts 27 so that the cylindrical part is within the body 1. The fuel chamber 11 is arranged in cooperation with the piston member 8 so that the piston member 8 pumps fuel in a way shown in FIGS. 1 and 2 from the chamber 11 through a non-return valve 15 and a duct 16 either directly or through a pressure accumulator into one or more cylinders of the engine (not shown; regarding the pressure accumulator arrangement reference is made to patent application Ser. No. 09/314,640 the entire disclosure of which is hereby incorporated by reference herein). On the other hand fuel is led into the chamber 11 from a low pressure fuel line of the engine (cf. FIGS. 3 and 4) through a duct 12, a control valve 13 and a non-return valve 14. By means of the control valve 13 the amount of fuel to be fed into the chamber 11 can be controlled and, when needed, the feeding may temporarily be entirely cut off. A cylinder-like lower part 10*a* of the cover element is so designed that it keeps the spring 9 at its proper position.

Figure 3:
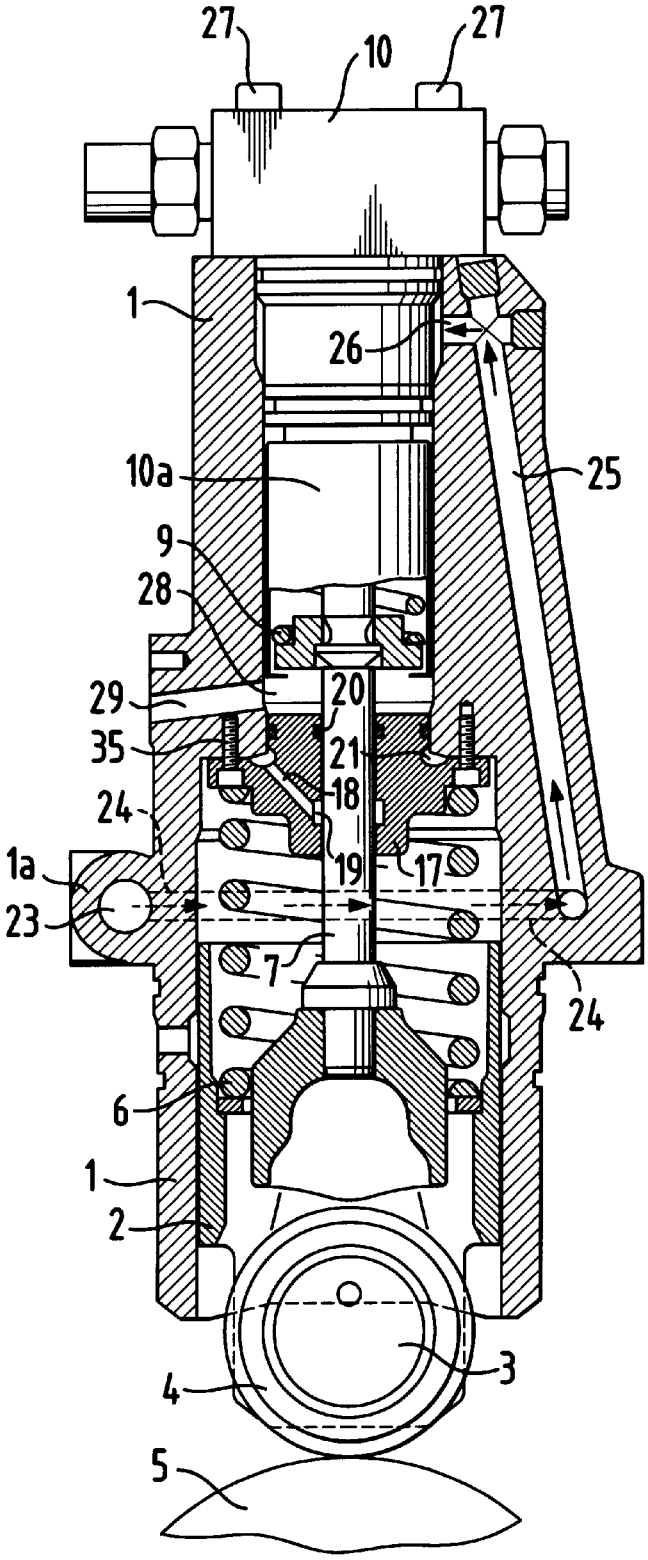
FIG. 3 shows a sectional view taken along the line III—III of the embodiment of FIG. 1 slightly modified.

A separate flange member 17, through which the tappet arm 7 is led, is fixed to the body 1 by means of screws 35. The flange member 17 is provided with one or more lubricator ducts 18, which connect a ring-like lubricator groove 21 to a lubricator groove 19 encircling the tappet arm 7. In addition the flange member 17 is provided with a sealing ring 20 providing a seal between the flange member and the tappet arm 7. An additional sealing ring provides a seal between the flange member and the body 1. Fuel and/or lubricant possibly accumulating in a chamber 28 located above the flange member 17 are led away through a drain duct 29 (FIG. 3). By means of these arrangements it is possible to minimize the fuel being mixed with the lubricant.

Figure 4:
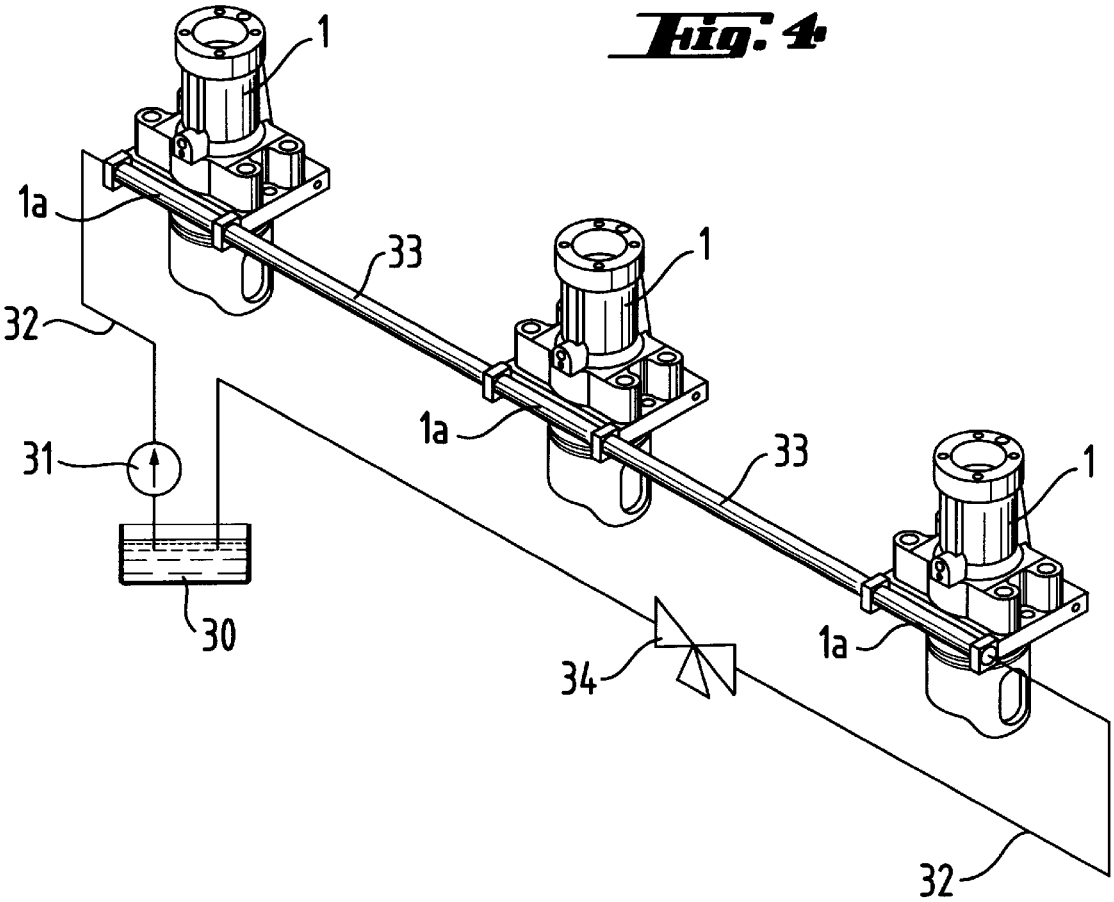
FIG. 4 illustrates several units according to the invention being arranged to be part of a low pressure fuel line of a fuel feeding system of an engine.

With reference specifically to FIGS. 3 and 4 the body 1 includes a pipe element 1*a*, a duct 23 of which is part of a fuel line 32 of a fuel feeding system of the engine. In addition the fuel feeding system comprises a low pressure pump 31, which pumps fuel from a fuel tank 30 to the pump and tappet units (for a matter of simplicity FIG. 4 shows only the bodies 1), pipes 33 connecting these units to one another through the pipe elements 1*a* and a constant pressure valve or a throttle valve 34, through which the fuel line 32 is led back into the fuel tank 30.

Figure 2:
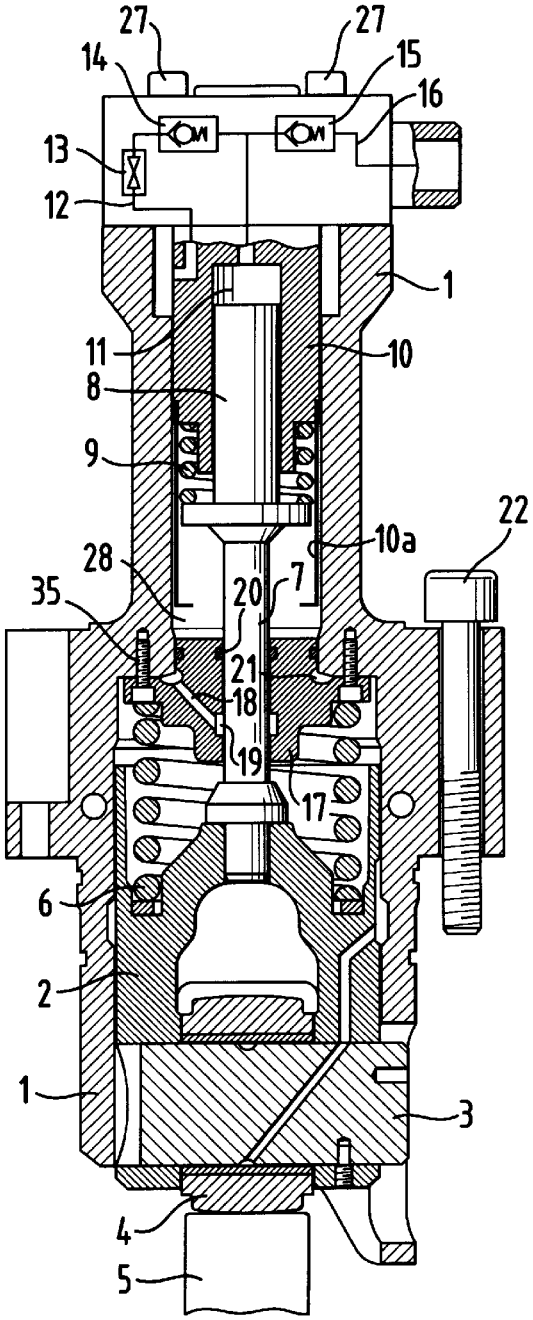
FIG. 2 shows the embodiment of FIG. 1 with the tappet in its upper position.

As is apparent from FIG. 3, in each pump and tappet unit the fuel is led from the duct 23 in the pipe element 1*a* onward through ducts 24, 25 and 26 into the duct 12, schematically shown in FIGS. 1 and 2, which leads the fuel into the fuel chamber 11 of the pump. Integration of the pipe element 1*a* and the separate fuel ducts and lubricator ducts with the body 1 to be manufactured as a one-piece casting makes the construction simpler and thereby requires less space and costs.

In the embodiment of FIG. 3 the tappet arm 7 connecting the tappet member 2 to the piston member 8 is somewhat differently designed. The tappet arm 7 may be composed of two separate pieces which, however, form one functional entity due to the spring 9.

The invention is not restricted to the embodiments shown but several modifications are feasible within the scope of the attached claims.

What is claimed is:

1. An integrated pump and tappet unit for an internal combustion engine, comprising:

a pump and tappet unit body composed of a one-piece casting, a tappet member fitted in the body to be driven by the engine, a tappet arm connected to the tappet member, a piston member operationally connected to the tappet member through the tappet arm and arranged to pump fuel from a fuel chamber in the body under high pressure to be fed to one or more cylinders of the engine, and a flange member fixed against movement relative to the pump and tappet body and through which the tappet arm extends, so that the piston member and the tappet member are at opposite respective sides of the flange member, and wherein the tappet arm is able to reciprocate relative to the flange member and is in sealing relationship with the flange member so that passage of fuel from the piston member side of the flange member to the tappet member side of the flange member is inhibited.

2. A pump and tappet unit according to claim 1, wherein the flange member is formed with a lubricator groove abutting the tappet arm and with a duct for leading lubrication oil into the lubricator groove.

3. A pump and tappet unit according to claim 2, wherein the flange member is provided with a sealing ring between the lubricator groove and the fuel chamber to prevent mixing of fuel and lubrication oil.

4. A pump and tappet unit according to claim 1, wherein the body defines a collecting chamber located between the flange member and the piston member for collecting fuel that might leak from the fuel chamber, and a drain duct for draining collected fuel from the collecting chamber.

5. A pump and tappet unit according to claim 1, comprising a non-return valve connecting a low pressure fuel line to the fuel chamber.

6. A pump and tappet unit according to claim 5, comprising a control valve upstream of the non-return valve.

7. A pump and tappet unit according to claim 5, wherein the pump and tappet body includes a pipe element for connecting as part of a low pressure fuel line, and the pump and tappet body is formed with ducts for connecting the pipe element with the fuel chamber.

8. A fuel supply system for a multi-cylinder internal combustion engine including a low pressure fuel line and at least two pump and tappet units each comprising:

a pump and tappet unit body composed of a one-piece casting and defining a fuel chamber, a tappet member fitted in the body to be driven by the engine, a tappet arm connected to the tappet member, a non-return valve connecting the low pressure fuel line to the fuel chamber, a piston member operationally connected to the tappet member through the tappet arm and arranged to pump fuel from the fuel chamber under high pressure to be fed to one or more cylinders of the engine, and a flange member fixed against movement relative to the pump and tappet body and through which the tappet arm extends, so that the piston member and the tappet member are at opposite respective sides of the flange member, and wherein the tappet arm is able to reciprocate relative to the flange member and is in sealing relationship with the flange member so that passage of fuel from the piston member side of the flange member to the tappet member side of the flange member is inhibited, and wherein the pump and tappet body of each pump and tappet unit includes a pipe element and is formed with ducts for connecting the pipe element with the fuel chamber, and the pipe elements of the pump and tappet bodies of the respective pump and tappet units are connected to each other for providing a common low pressure fuel supply line.

* * * * *